US011399994B2

(12) United States Patent
Smink et al.

(10) Patent No.: US 11,399,994 B2
(45) Date of Patent: Aug. 2, 2022

(54) DEVICE CONFIGURED TO TRANSPORT A HUMAN BODY

(71) Applicant: Retter Medical Holding B.V., Nijmegen (NL)

(72) Inventors: Riemer Jellis Jan Smink, Amsterdam (NL); Floris Wiegerinck, Hilversum (NL)

(73) Assignee: RETTER HELFER MEDICAL B.V., Amstelveen (NL)

( * ) Notice: Subject to any disclaimer, the term of this patent is extended or adjusted under 35 U.S.C. 154(b) by 500 days.

(21) Appl. No.: 16/500,443

(22) PCT Filed: Apr. 11, 2018

(86) PCT No.: PCT/NL2018/050222
§ 371 (c)(1),
(2) Date: Oct. 3, 2019

(87) PCT Pub. No.: WO2018/190709
PCT Pub. Date: Oct. 18, 2018

(65) Prior Publication Data

US 2020/0188199 A1 Jun. 18, 2020

(30) Foreign Application Priority Data

Apr. 13, 2017 (NL) ..... 2018713

(51) Int. Cl.
*A61G 5/00* (2006.01)
*A61G 5/12* (2006.01)
(Continued)

(52) U.S. Cl.
CPC ..... *A61G 5/006* (2013.01); *A61G 5/128* (2016.11); *A61G 1/017* (2013.01); *A61G 1/02* (2013.01); *A61G 2200/32* (2013.01)

(58) Field of Classification Search
CPC ..... A61G 5/00; A61G 5/006; A61G 5/128; A61G 1/017; A61G 1/02; A61G 2200/32
See application file for complete search history.

(56) References Cited

U.S. PATENT DOCUMENTS 3,116,492 A 1/1964 Christensen
3,921,231 A 11/1975 Bourgraf et al.
(Continued)

FOREIGN PATENT DOCUMENTS

DE 3320866 A1 12/1984
GB 2360255 A 9/2001
WO 2015140767 A1 9/2015

OTHER PUBLICATIONS

International Search Report and Written Opinion for the International Patent Application No. PCT/NL2018/050222, dated Jun. 15, 2019, 11 pages.

*Primary Examiner* — Fredrick C Conley
(74) *Attorney, Agent, or Firm* — KDB Firm PLLC

(57) ABSTRACT

A device includes a main frame; at least one wheel; and supports. The supports are arranged in a support frame movably connected to the main frame. The support frame comprises a seat sub frame and a leg sub frame. The seat sub frame or the leg sub frame is fixedly hinged to the main frame, and the other is displaceably hinged to the main frame. A transformation mechanism associated with the main frame can convert the device between a planar support state and an angled support state. Supports enclose an angle to define a seat and backing support. The leg sub frame is extended beyond its hinge relative to the main frame and comprises a set of wheels at the free end of the extended leg sub frame. The extended leg sub frame provides a sturdy wheel base in the angled support state to define a wheel chair mode.

15 Claims, 8 Drawing Sheets

(51) Int. Cl.
*A61G 1/017* (2006.01)
*A61G 1/02* (2006.01)

(56) References Cited

U.S. PATENT DOCUMENTS

| | | | | |
|---|---|---|---|---|
| 8,104,121 | B2 | 1/2012 | Bourgraf et al. | |
| 2007/0182220 | A1 | 8/2007 | Walkinshaw et al. | |
| 2015/0320627 | A1 | 11/2015 | Tsukada et al. | |
| 2018/0028377 | A1* | 2/2018 | Stryker | A61G 1/017 |
| 2018/0028383 | A1* | 2/2018 | Stryker | A61G 1/017 |
| 2018/0185213 | A1* | 7/2018 | Naber | A61G 5/066 |

* cited by examiner

DEVICE CONFIGURED TO TRANSPORT A HUMAN BODY

This is a national stage application filed under 35 U.S.C. § 371 of pending international application PCT/NL2018/050222 filed Apr. 11, 2018, which claims priority to Netherlands patent application NL2018713, filed Apr. 13, 2017, the entirety of which applications are hereby incorporated by reference herein.

The present invention relates to a device, in particular to a transport device that is configured to transport a human body, such as a patient.

Transport devices that are configured to transport a human body exist in various embodiments, including stretchers in various forms, wheel chairs, etc.

Ambulance personnel are exposed to various physically demanding situations during work. For example, raising a stretcher, carrying heavy equipment, riding with (heavy) patients on slopes and curbs, and evacuating patients on stairs impose a physical load for the personnel.

Whereas prior art electric stretchers reduce the load of raising a stretcher with a human body on it, the heavy weight of around 70 kg and handling of the electric stretcher itself often results in paramedics leaving the electric stretcher in the ambulance and only carrying the items that they really need. The equipment, e.g. comprising a medicine bag, monitor, and oxygen bottle, may however weigh more than 30 kg. Insufficient room for maneuvering an (electric) stretcher due to tight turns, limited width of doors, and small elevators, is another reason why such stretchers are often left in the ambulance.

DE 33 29 866 is considered the closest prior art, relative to which at least the characterizing features of claim 1 are novel. It discloses a device configured to transport a patient, wherein a lying patient may be brought into a somewhat seated posture. However, in order to transport the patient, the main frame has to be tilted backward until the wheel, that is arranged about midway the length of the main frame, contacts the ground. The patient is thus merely in a lying position during transport. Moreover, conversion takes effort and time, also requiring storing away of handle bars.

U.S. Pat. No. 3,921,231 discloses a break-away scoop stretcher composed of three detachable frame sections adapted to be selectively interengaged to extricate and transport a critically injured person in various positions, including prone, seated and fetal, depending upon the position in which the injured person is found. The conversion of the transport device of U.S. Pat. No. 3,921,231 takes considerable effort and time, wherein the three frame sections may have to be detached and combined again in another configuration. For example, from scoop to seat, the parts have to be taken apart, and a middle section has to be removed, before a backing section and a seating section are combined again. In an emergency situation, the time required to adapt this prior art device may make the difference between life and death of an injured person.

The international patent application WO 2915/149767, the United States publications U.S. Pat. No. 3,116,492, US 2015/320627, US 2007/182220 and U.S. Pat. No. 8,104,121, as well as the United Kingdom patent application GB 2 360 255, are acknowledged as further prior art.

An object of the present invention is to provide a device, that is improved relative to the prior art and wherein at least one of the above stated problems is obviated.

Said object is achieved with the device according to the present invention, comprising:

a main frame;

one or more than one wheel that is associated with the main frame;

supports;

wherein the supports are arranged in a support frame that is movably connected to the main frame;

wherein the support frame comprises a seat sub frame and a leg sub frame;

wherein one of the seat sub frame and the leg sub frame is fixedly hinged relative to the main frame, and wherein the other of the seat sub frame and the leg sub frame is displaceably hinged relative to the main frame; and a transformation mechanism associated with the main frame and configured to convert the device between a planar support state and an angled support state, wherein supports enclose an angle to define a seat and backing support, and vice versa;

wherein the leg sub frame is extended to beyond its hinge relative to the main frame and comprises a set of wheels at the free end of the extended leg sub frame, wherein the extended leg sub frame is configured to provide a sturdy wheel base in the angled support state to define a wheel chair mode.

The planar support state is configured to support a human body in a lying state or in a seating state, wherein the back is not supported. The angled support state, wherein supports enclose an angle to define a seat and backing support, is configured to support a human body in a seating state, offering back support.

Consequently, the device according to the invention can be adapted to a specific situation. For people or patients that could be transported in a seating position, the angled support state can be used, offering improved maneuverability relative to a stretcher-like planar support state. Research has shown that many patients could be transported while sitting upright or under a slight back angle.

Moreover, in the angled support state, the device may also be used as an equipment trolley, allowing ambulance personnel to comfortably and securely transport their heavy medical equipment towards an emergency. On the way back to the ambulance, the device may be used in its angled support state as either an equipment trolley or as a wheel chair for transporting a patient.

A stable wheelchair or equipment trolley is obtained by the leg sub frame that is extended to beyond its hinge relative to the main frame and that comprises a set of wheels at the free end of the extended leg sub frame. The extended leg sub frame is configured to provide a sturdy wheel base in the angled support state to define a wheel chair mode. The extended leg sub frame positions the wheels at a mutual distance that is sufficient to provide a sturdy wheel base. In this way, a human body or equipment may be easily and safely transported in the wheelchair mode of the transport device. In wheelchair mode, the center of gravity of the transport device and human body is substantially centered between the wheels.

In a preferred embodiment, the support frame further comprises a backing sub frame that is displaceably hinged relative to the main frame. The device thus comprises the support frame that comprises the seat sub frame, the leg sub frame, and the backing sub frame. The seat sub frame is hingedly connected to the leg sub frame at a first side thereof, and hingedly connected to the backing sub frame at a second side thereof, wherein the first side and second side are opposite sides of the seat sub frame. If both the backing sub frame and the seat sub frame are displaceably hinged relative to the main frame, and the leg sub frame is fixedly hinged relative to the main frame, the transport device may be converted between the planar support state and the angled support state, and vice versa, at a great ease of handling, providing improved operability.

Preferred embodiments are the subject of the dependent claims.

In the following description preferred embodiments of the present invention are further elucidated with reference to the drawing, in which.

Figure 1:
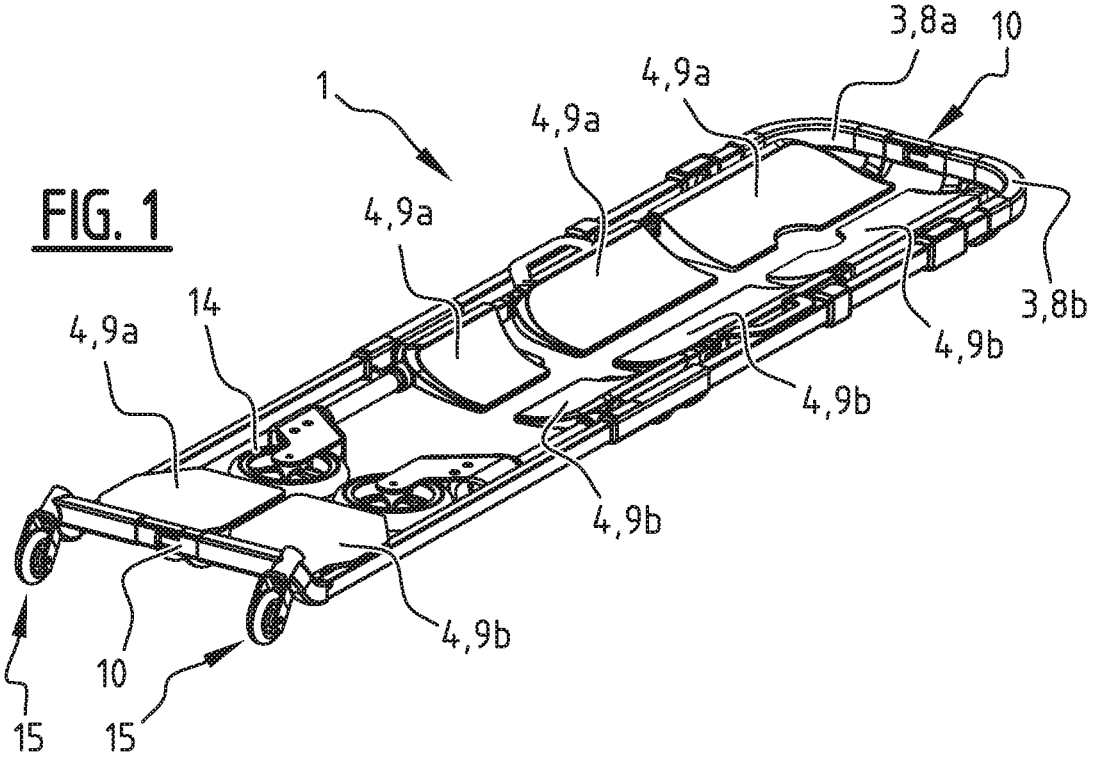
FIG. 1 is a perspective view of a device according to the invention in a planar support state.

The device 1 is a transport device that is configured to transport a human body 2, such as a patient. Device 1 comprises a main frame 3 and supports 4. A transformation mechanism 5 that is associated with the main frame 3 is configured to convert the device 1 between a planar support state (FIG. 1) and an angled support state (FIG. 2), wherein supports 4 enclose an angle α to define a seat 6 and backing support 7, and vice versa.

The supports are arranged in a support frame that is movably connected to the main frame 3, wherein the support frame 12 comprises a seat sub frame 12-2 and a leg sub frame 12-1, and preferably a backing sub frame 12-3.

Figure 3:
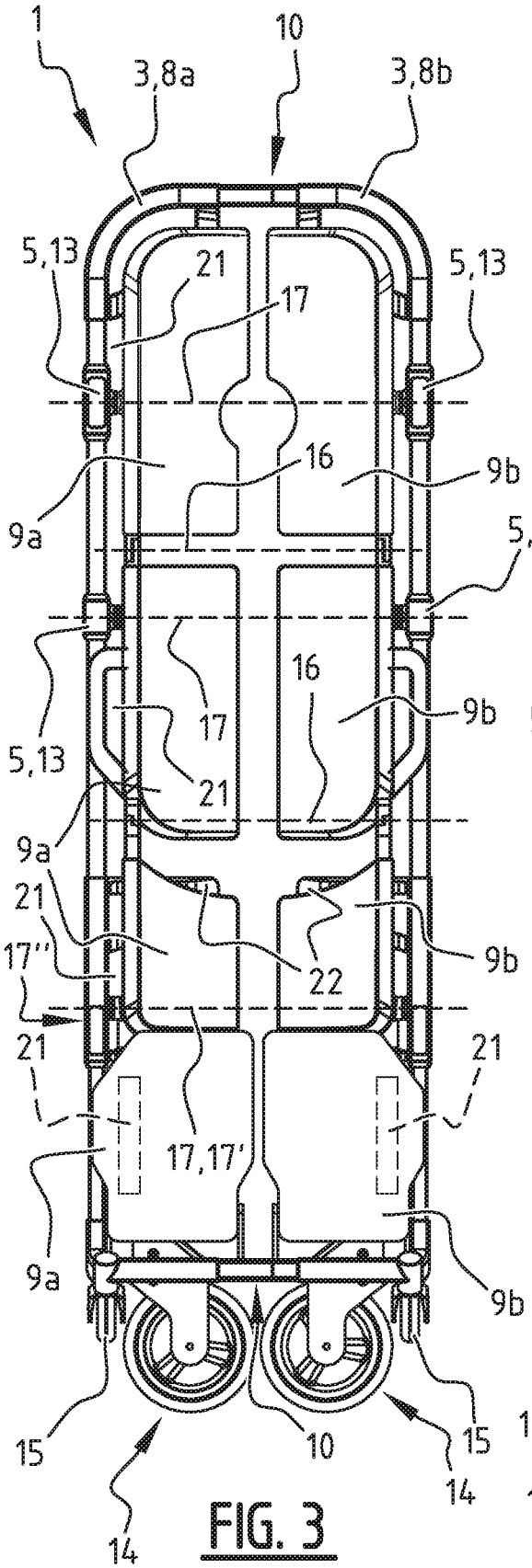
FIG. 3 shows a top view of the device in a collapsed storing state.
Figure 4:
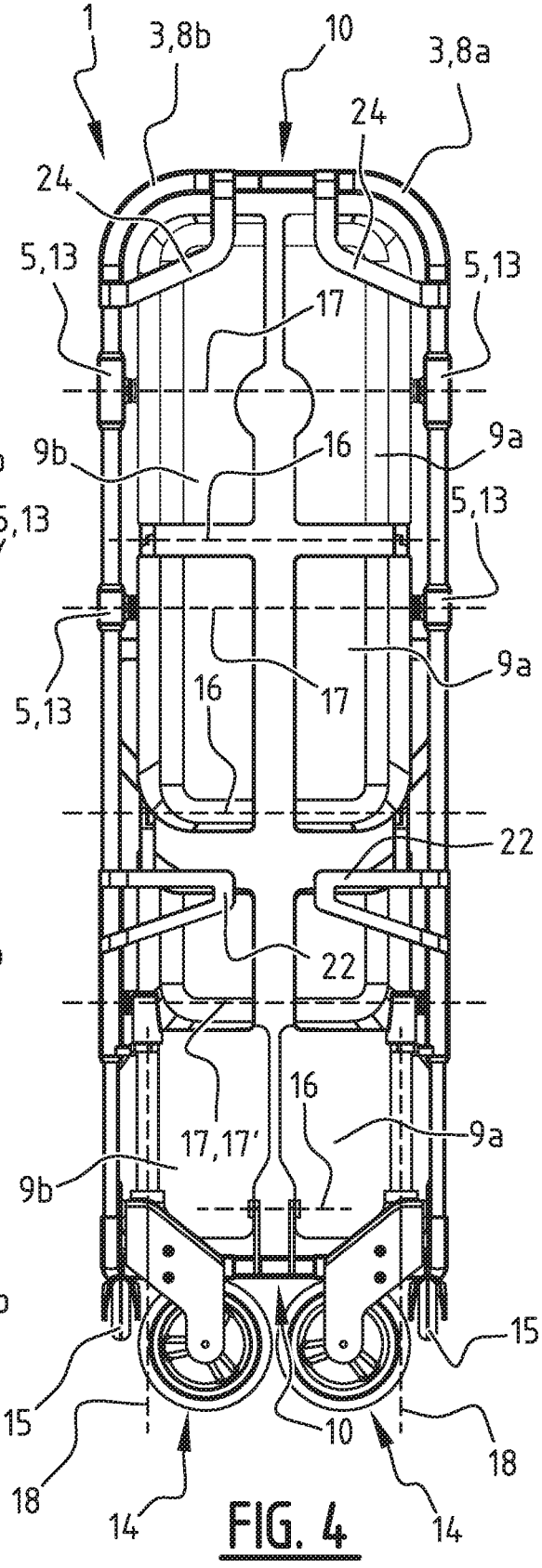
FIG. 4 shows a bottom plan view of the device in the collapsed storing state.

In the shown embodiment, the leg sub frame 12-1 is fixedly hinged relative to the main frame 3, and the seat sub frame 12-2 is displaceably hinged relative to the main frame 3. The leg sub frame 12-1 pivots around a pivot axis 17' (FIGS. 3 and 4).

Figure 2:
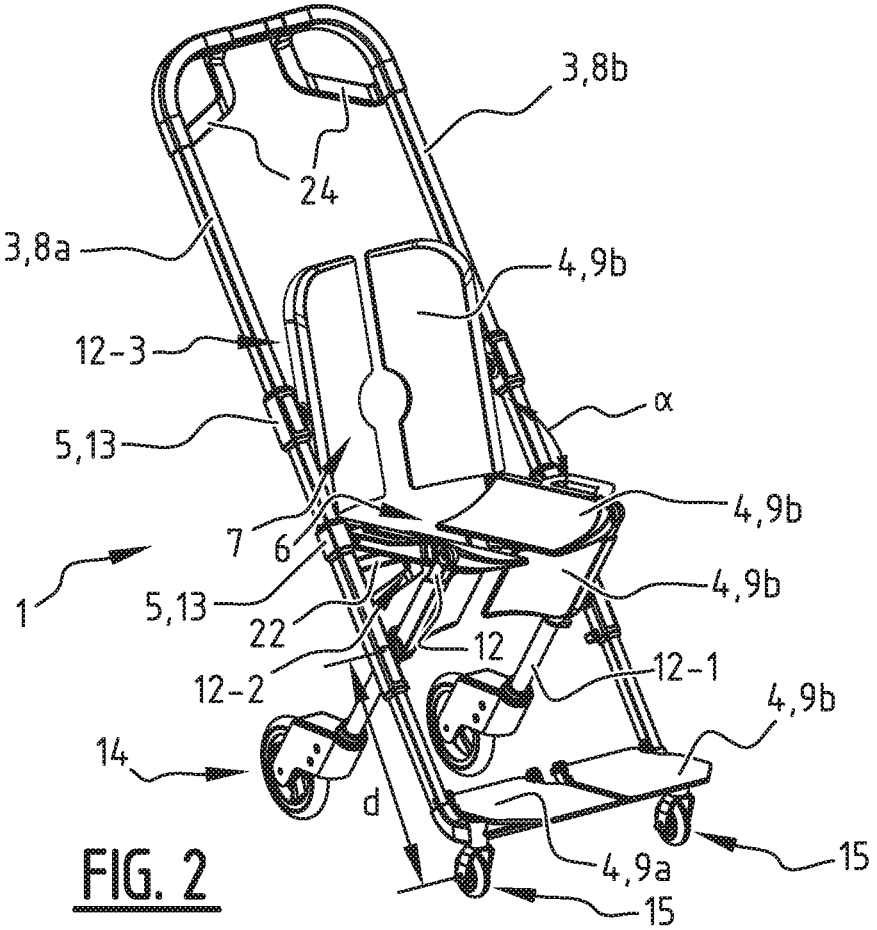
FIG. 2 is a perspective view of the device of FIG. 1 in an angled support state.

In the angled support state of FIG. 2, the leg sub frame 12-1 is extended to beyond its hinge 17", i.e. pivot axis 17', relative to the main frame 3 and comprises a set of wheels 14 at the free end of the extended leg sub frame 12-1, wherein the extended leg sub frame 12-1 is configured to provide a sturdy wheel base in the angled support state to define a wheel chair mode.

The pivot axis 17' is arranged along a longitudinal direction of the main frame 3, at a distance from the one or more than one wheel 15 that is associated with the main frame 3, and that is arranged at an end of said main frame 3. In the shown embodiment, two wheels 15 in the form of castor wheels are applied. The distance d between the wheels 15 associated with the main frame 3 and the hinge 17" of the leg sub frame 12-1, i.e. pivot axis 17', allows the wheels 14 that are arranged at the free end of the extended leg sub frame 12-1 to be arranged at a distance from the one or more than one wheel 15 that is associated with the main frame 3. In this way, a sturdy wheel base is guaranteed.

The shown device 1 comprises four supports 4, allowing the human body 2 to be supported over substantially most of its surface (FIG. 8C) in an essentially lying position of said body 2. At least two supports 4 are required to provide a seat 6 and backing support 7 in the angled support state.

The main frame 3 comprises two sub main frames 8*a*, 8*b* that divide the main frame 3 in two complementary halves. This can be best seen in FIG. 8A. The sub main frames 8*a*, 8*b* are pivotably (FIG. 8B) and/or releasably (FIG. 8A) connected, allowing the device 1 to be used as a scoop stretcher. Scoop stretchers are most frequently used to lift injured people from the ground, either because of unconsciousness or in order to maintain stability in the case of trauma with suspected spinal cord injury. Scoop stretchers reduce the chance of undesirable movement of injured areas during transfer of a trauma patient, as they maintain the patient in a supine alignment during transfer. The connection between the sub main frames 8*a*, 8*b* preferably comprises a safety hinge 10.

One or more than one of the supports 4 comprises two support parts 9*a*, 9*b*, wherein the support parts 9*a*, 9*b* are each connected to one of the sub main frames 8*a*, 8*b* of the main frame 3. In order to allow the device 1 being used as a scoop stretcher, preferably all supports 4 comprise two support parts 9*a*, 9*b*, as shown in the figures.

In order to provide a stable support for the human body 2 in the angled support state, the supports are preferably reinforced. As a reinforcement, the device 1 preferably comprises a connection 11 configured to connect two support parts 9*a*, 9*b* of a support 4 in at least the angled support state. The connection 11 (FIG. 9D) may comprise a flexible (Velcro®) band or a rigid link.

A further reinforcement may be formed by a supporting bracket 22, that extends from the main frame 3 inward, and is configured to support the supports that provide the seat support 6 in the angled support state. The supporting bracket 2 thus prevents sagging of the seat support 6 due to the weight of a human body sitting thereon.

As shown in FIGS. 3 and 4, supports 4 may also rest on the supporting bracket 22 in the planar support state. The supporting bracket 22 thus also reinforces the planar support state.

Finally, supporting bracket 22 may support equipment. For example, it may function as an attachment for an oxygen bottle holder.

A further reinforcement may be formed by one or more than one additional supporting bracket 24 that is configured to support the supports 4 that are designed to receive a head and shoulder area of a human body 2. In the angled support state, the additional supporting brackets 24 may also be used as a handle for pushing the device 1 as a wheelchair.

The supports 4 are pivotable relative to each other, allowing the device 1 to be converted between the planar support state and the angled support state, wherein the supports 4 enclose an angle α to define a seat 6 and backing support 7, and vice versa.

The supports 4 are also moveable relative to the main frame 3, allowing the supports 4 to move towards each other when the device 1 is converted from the planar support state towards the angled support state.

In the shown embodiment, especially in FIGS. 2 and 9B-9D, the supports 4 are arranged in a support frame 12 that is movably connected to the main frame 3. More in particular, the support frame 12 is slideable relative to the main frame 3, e.g. using sliders 13 of the transformation mechanism 5. The transformation mechanism 5 thus preferably comprises one or more than one slider 13 that slidingly and pivotably connects the support frame 12 to the main frame 3.

The supports 4 are pivotable relative to each other around pivot axes 16, using support frame 12 (FIGS. 3 and 4). The support frame 12 and the supports 4 are pivotable relative to the main frame 12 around pivot axes 17 (FIGS. 3 and 4).

In order to allow paramedics to secure a human body to the device 1 in the planar support state, slots 21 that are configured for guiding a belt therethrough, are provided. The supports 4 that are configured to function as a footrest in the angled support state also support feet of a human body in the planar support state shown in FIGS. 3 and 4. These supports are provided with slots 21 in the support 4 itself. The other slots are formed between the supports 4 and the main frame 3. The sliders 13 and associated axes 17 may form boundaries of said slots 21.

In the shown embodiment, the optional support frame 12 is also considered part of the transformation mechanism 5. The skilled person will however understand that it is conceivable that the supports 4 may be directly linked to each other and sliders 13 without a support frame 12.

In order to allow the device 1 to be used as a wheel chair in the angled support state (FIG. 2), the device 1 comprises wheels 14 that are associated with the transformation mechanism 5 to be exposed and operational in at least one of the planar support state and the angled support state. The wheels 14 are inoperative and in a storing position in the other of the planar support state and the angled support state. In the shown embodiment, the wheels 14 that are associated with the transformation mechanism 5 are exposed in the angled support state.

Figures 9A, 10:
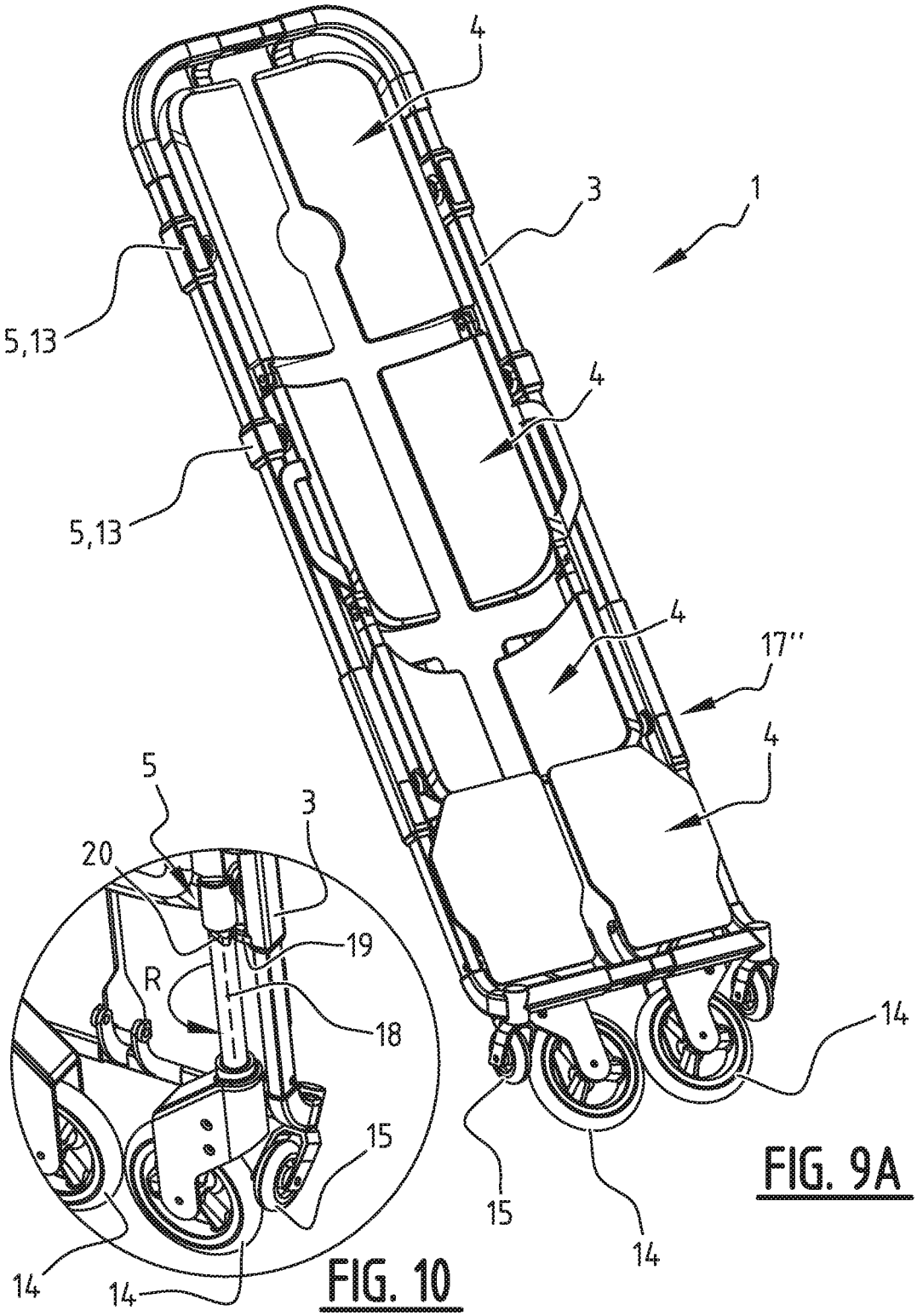
FIGS. 9A-9D show successive states of converting the device from a planar support state to an angled support state.
FIG. 10 is a perspective detail view of the wheels of the device.

The wheels 14 that are associated with the transformation mechanism 5 are arranged on the support frame 12. The transformation mechanism 5 comprises a cam 19 that is arranged on the main frame 3. This cam 19 engages a cam follower 20, and forces the wheels 14 against a spring force of a (not shown) spring into the exposed and operational state (indicated with arrow R in FIG. 10) when the device 1 is converted from the planar support state to the angled support state. The wheels 14 rotate relative to a rotation axis 18 (FIGS. 4 and 10).

Figure 9B:
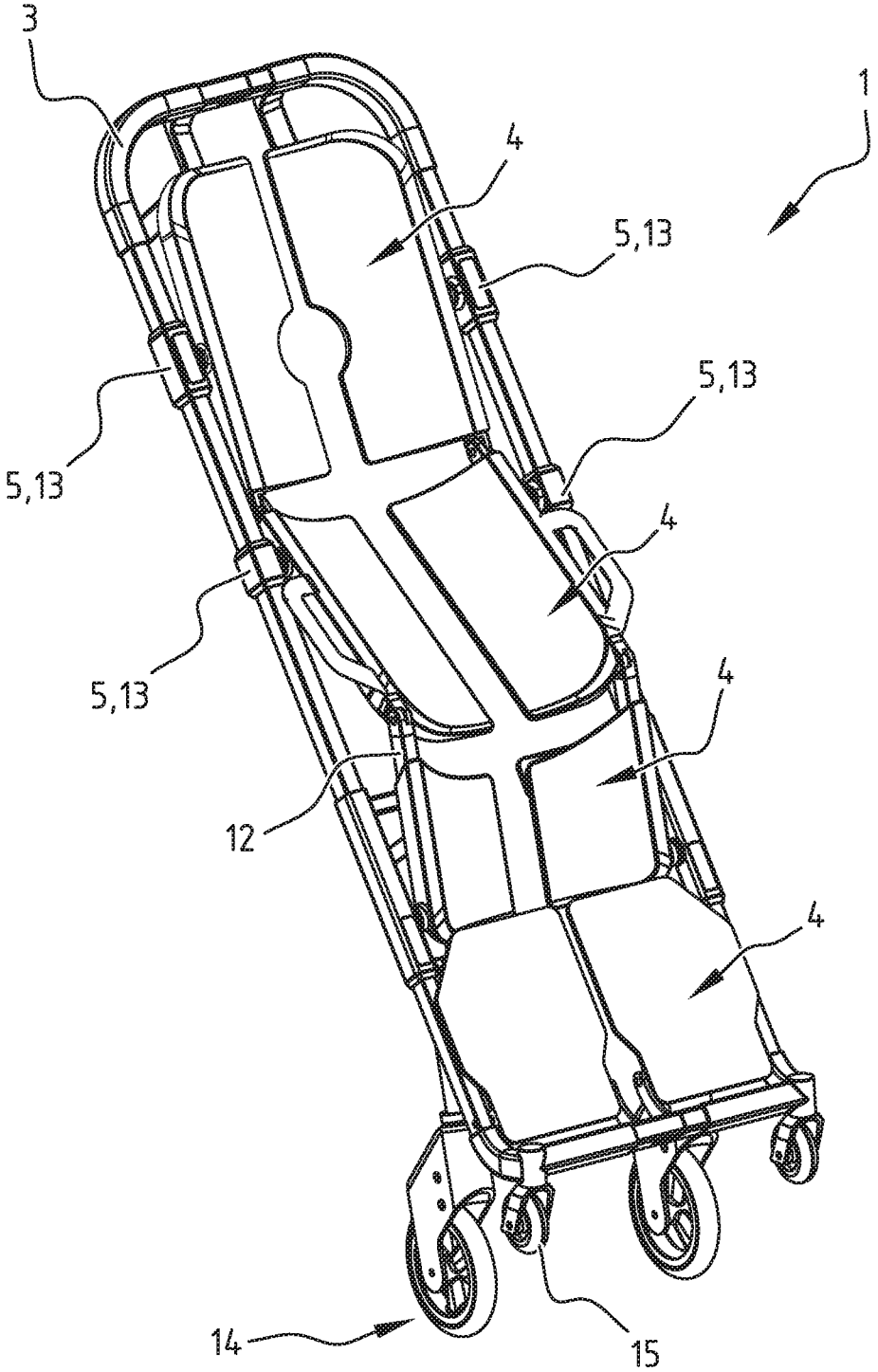
Figure 9C:
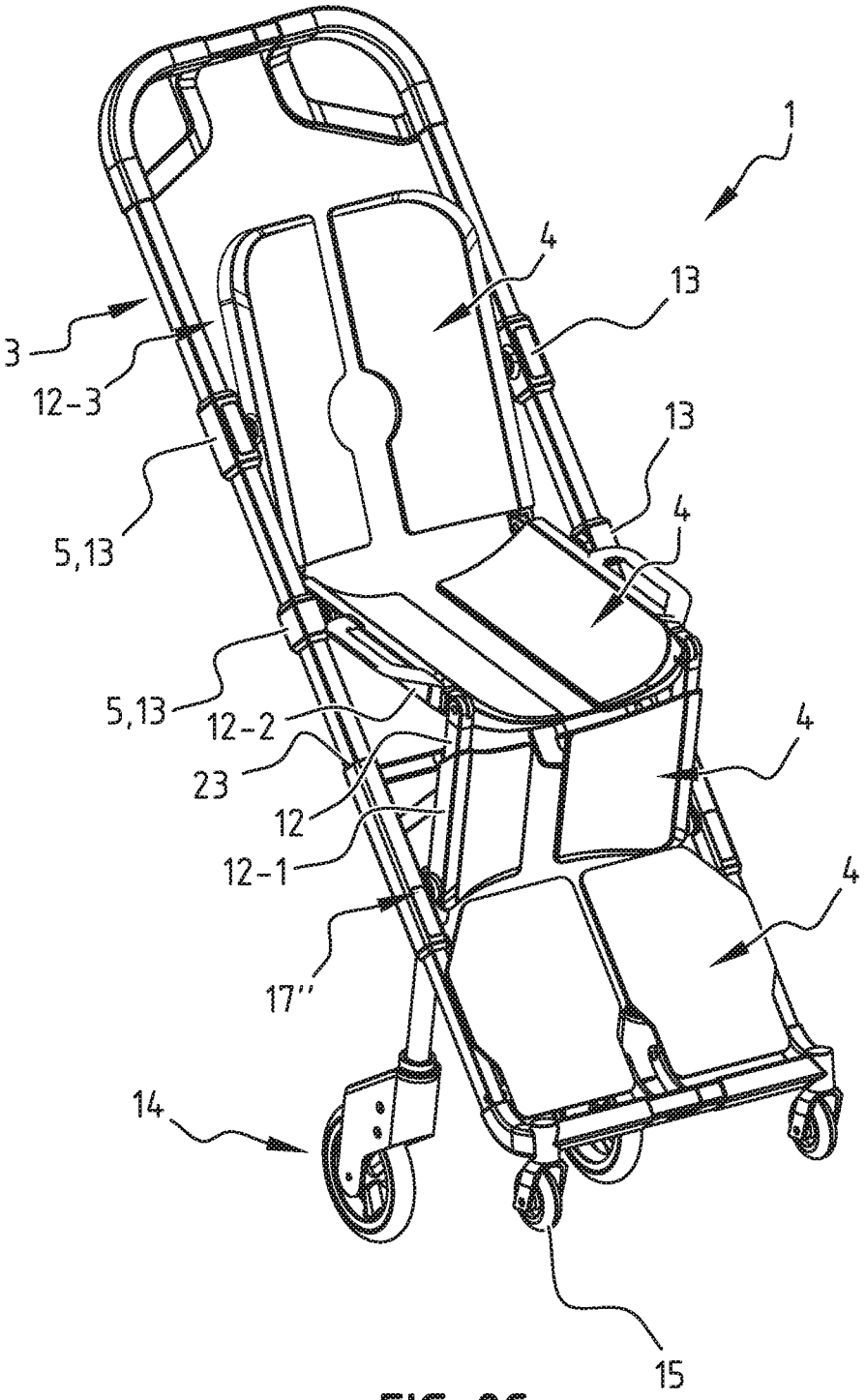
Figure 9D:
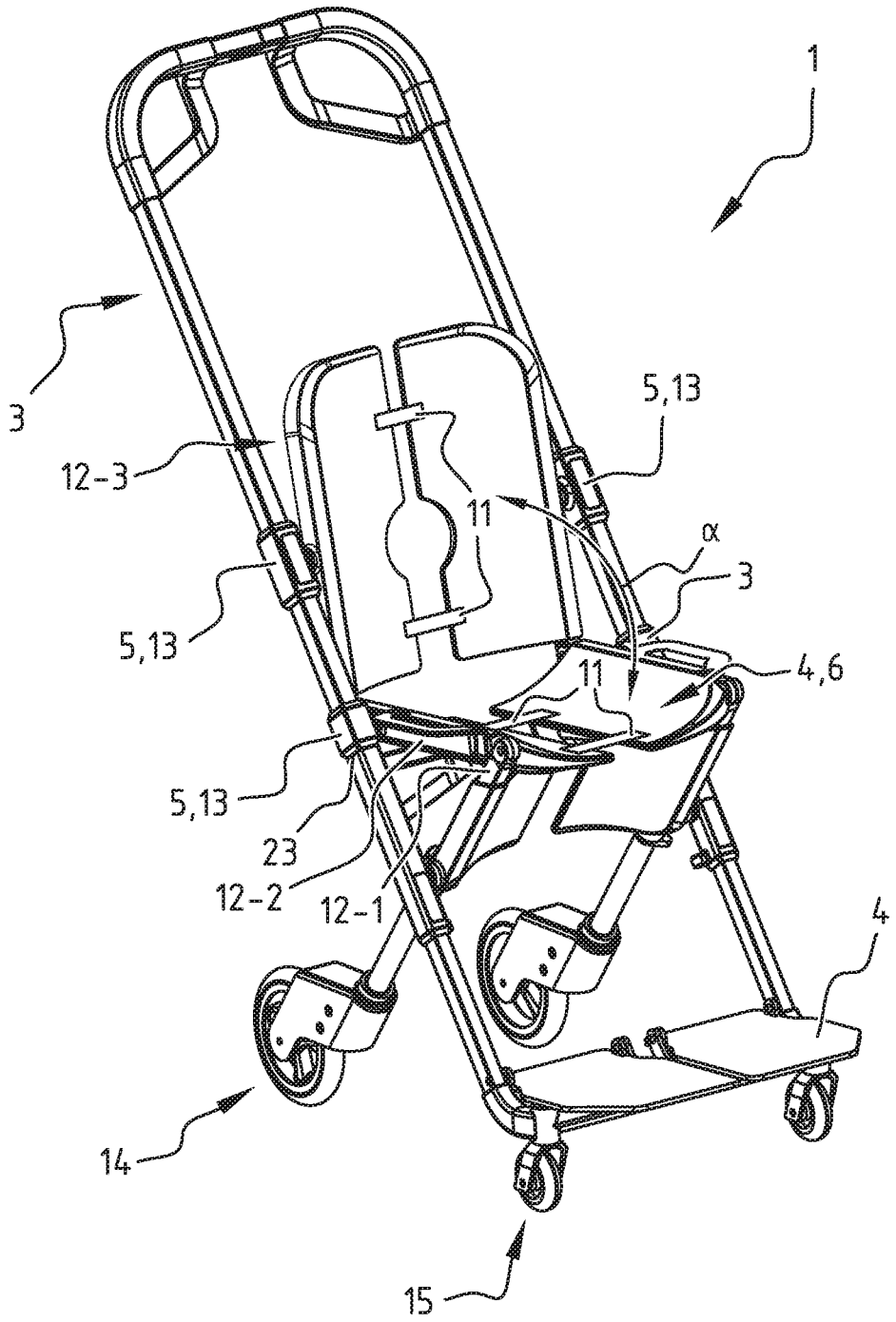

The device 1 further comprises one or more than one wheel 15 that is associated with the main frame 3. In FIG. 1, two wheels 15 are shown, which allow the device 1 to be pulled away in the planar support state (FIGS. 1, 6 and 7) by a single paramedic. The wheels 15 are preferably castor wheels, providing additional maneuverability to the device 1 when the device 1 functions as a wheel chair or equipment trolley in the angled support state thereof (FIGS. 2 and 9D).

The transformation mechanism 5 preferably further comprises a (not shown) lock that is configured to lock the supports 4 relative to the main frame 3 in at least one of the planar support state and the angled support state. Such a lock may be arranged in a slider 13, locking the slider 13 relative to the main frame 3, and thus locking the support frame 12 and supports 4 relative to the main frame 3. The weight of the human body may push the sliders 13 against an end stop 23 (FIG. 9D), which may comprise the lock of the transformation mechanism 5. An alternative lock may lock the angle between adjacent supports 4.

Figure 7:
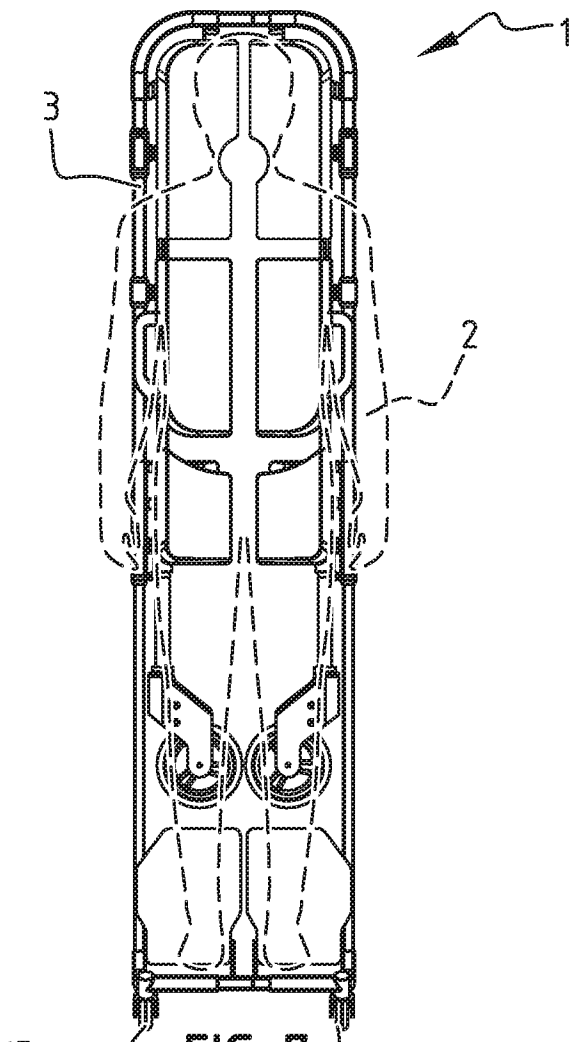
FIGS. 5-7 show successive states of extending the device from the collapsed storing state to operational planar support states.
Figure 6:
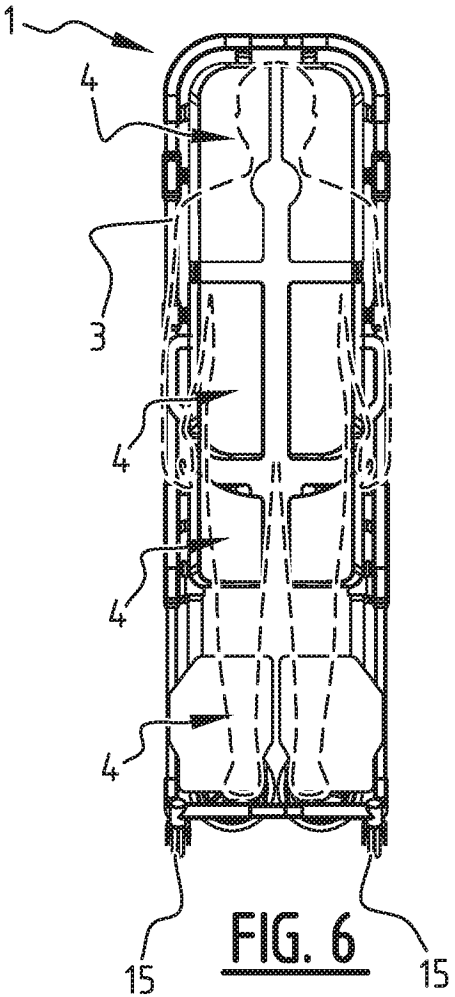
Figure 5:
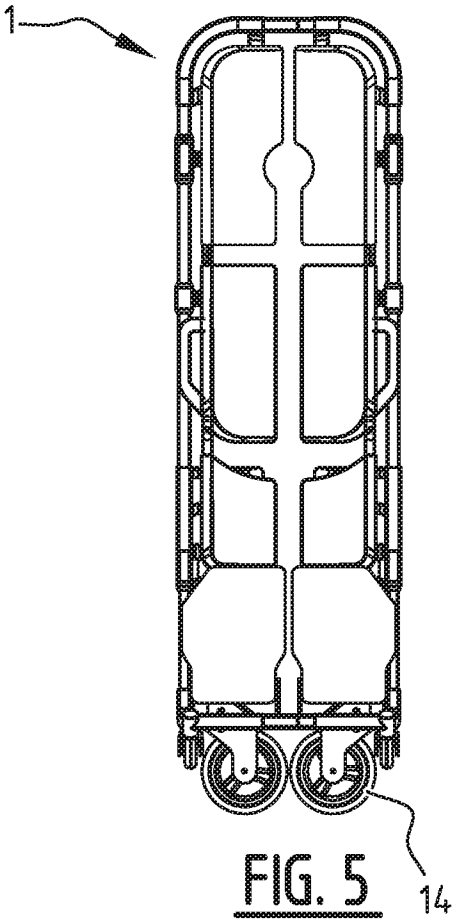

Successive states of extending the device 1 from a collapsed storing state (FIG. 5) to operational planar support states are shown in FIGS. 5-7. The main frame 3 is extendable and is extended in correspondence to the length of a patient 2. The main frame 3 is lockable in a plurality of extended positions. FIG. 6 shows an intermediate extension for a small patient 2 and FIG. 7 a fill extension of the main frame 3 for supporting a large patient 2.

Figures 8A, 8B, 8C:
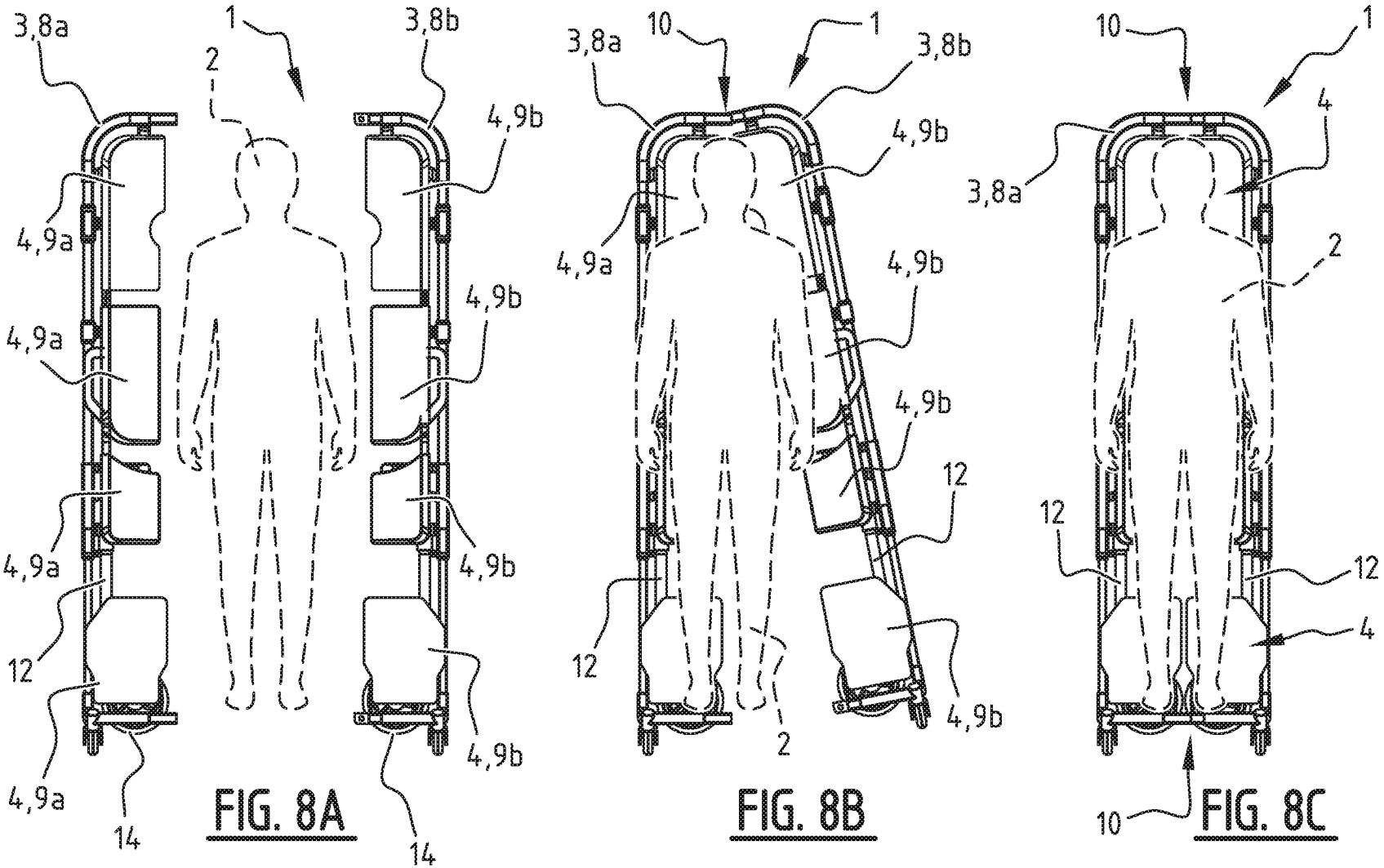
FIGS. 8A-8C show the device functioning as a scoop stretcher.

After adjusting the length of the device 1, it may be used as a scoop stretcher, shown in FIGS. 8A-8C.

Alternatively, the device 1 may be converted from the planar support state of FIG. 9A towards the angled support state of FIG. 9D. FIGS. 9B and 9C show intermediate positions, wherein the sliders 13 of the transformation mechanism 5 slide along the main frame 3 and the support frame 12 gradually pivots the supports 4 relative towards each other until they end in the angled support state of FIG. 9D, wherein two supports 4 enclose an angle $\alpha$ to define a seat 6 and backing support 7.

The above described embodiment is intended only to illustrate the invention and not to limit in any way the scope of the invention. Accordingly, it should be understood that where features mentioned in the appended claims are followed by reference signs, such signs are included solely for the purpose of enhancing the intelligibility of the claims and are in no way limiting on the scope of the claims. The scope of the invention is defined solely by the following claims.

The invention claimed is:

1. A device, comprising:

a main frame;

at least one wheel associated with the main frame;

supports;

wherein the supports are arranged in a support frame that is movably connected to the main frame;

wherein the support frame comprises a seat sub frame and a leg sub frame; and wherein one of the seat sub frame and the leg sub frame is fixedly hinged relative to the main frame, and wherein the other of the seat sub frame and the leg sub frame is displaceably hinged relative to the main frame; and a transformation mechanism associated with the main frame and configured to convert the device between a planar support state and an angled support state, wherein the supports enclose an angle to define a seat and backing support, and vice versa;

wherein, in the angled support state, the leg sub frame is extended to beyond its hinge relative to the main frame and comprises a set of wheels at the free end of the extended leg sub frame, and wherein the extended leg sub frame is configured to provide a sturdy wheel base in the angled support state to define a wheel chair mode.

2. The device according to claim 1, wherein the support frame further comprises a backing sub frame that is displaceably hinged relative to the main frame.

3. The device according to claim 1, wherein the main frame comprises two sub main frames that divide the main frame in two complementary halves.

4. The device according to claim 3, wherein the sub main frames are at least one of pivotably and releasably connected.

5. The device according to claim 3, wherein at least one of the supports comprises two support parts, wherein the support parts are each connected to one of the sub main frames of the main frame.

6. The device according to claim 5, comprising a connection configured to connect two support parts of a support in at least the angled support state.

7. The device according to claim 1, wherein the supports are pivotable relative to each other.

8. The device according to claim 1, wherein the supports are moveable relative to the main frame.

9. The device according to claim 1, wherein the support frame is slideable along the main frame.

10. The device according to claim 1, further comprising wheels associated with the transformation mechanism to be exposed and operational in at least one of the planar support state and the angled support state, and to be inoperative and in a storing position in the other of the planar support state and the angled support state.

11. The device according to claim 10, wherein the wheels associated with the transformation mechanism are exposed in the angled support state.

12. The device according to claim 10, wherein the wheels associated with the transformation mechanism are arranged on the support frame.

13. The device according to claim 10, wherein the transformation mechanism comprises a cam that forces the wheels into the exposed and operational state when the device is converted from the planar support state to the angled support state.

14. The device according to claim 1, wherein the transformation mechanism comprises a lock configured to lock the supports relative to the main frame in at least one of the planar support state and the angled support state.

15. The device according to claim 1, wherein the transformation mechanism comprises at least one slider that slidingly connects the support frame to the main frame.

* * * * *